US005996246A

United States Patent [19]

Marschke

[11] Patent Number: 5,996,246

[45] Date of Patent: Dec. 7, 1999

[54] EDGE SEAL FOR VACUUM PREHEATER

[75] Inventor: Carl R. Marschke, Phillips, Wis.

[73] Assignee: Marquip, Inc., Phillips, Wis.

[21] Appl. No.: 09/088,214

[22] Filed: Jun. 1, 1998

[51] Int. Cl.[6] ..... F26B 5/06

[52] U.S. Cl. ..... 34/297; 34/417; 34/634; 34/646

[58] Field of Search ..... 34/290, 297, 417, 34/459, 624, 629, 634, 646, 660, 663, 242; 156/345, 470; 226/95, 170; 355/76, 92

[56] References Cited

U.S. PATENT DOCUMENTS 3,929,551 12/1975 Frantzen ..... 156/345
4,825,255 4/1989 Iaia, Jr. et al. ..... 355/76
5,424,805 6/1995 Leonhart et al. ..... 335/92
5,501,762 3/1996 Marscke et al. ..... 156/470
5,600,900 2/1997 Marschke ..... 34/519
5,706,994 1/1998 Welch et al. ..... 226/95
5,857,605 1/1999 Welch et al. ..... 226/95

*Primary Examiner*—Henry Bennett
*Assistant Examiner*—Steve Gravini
*Attorney, Agent, or Firm*—Andrus, Sceales, Starke & Sawall

[57] ABSTRACT

Flexible edge sealing membranes cooperate with the heating surface of a vacuum preheater and a web moving over the surface (1) to minimize air loss in the portions of the heating surface not covered by the web, (2) to prevent differential heating of the edges of the web induced by unrestricted air flow, and (3) to provide reduced friction contact with the edge portions of the web.

6 Claims, 2 Drawing Sheets

EDGE SEAL FOR VACUUM PREHEATER

BACKGROUND OF THE INVENTION

The present invention relates to applying heat to a moving web of material and, in particular, to an apparatus and method for preheating a paper web to precondition the same, as for combination in a corrugated paperboard web.

In the manufacture of corrugated paperboard, the various component paper webs are usually preheated prior to the application of an adhesive and the joining of one web to another. A common preheating device in a corrugator comprises a rotating steam-heated roll around which the moving paper web is partially wrapped and heated before it is transferred to downstream processing equipment, such as a single facer or a double backer.

More recently, it has been found that web preheating devices may be substantially simplified and the heat transfer to the web provided more efficiently by utilizing a heated stationary plate over which the web travels. It has also been found to be effective to apply a vacuum holddown force to such hot plates by providing vacuum openings in the heating surface to which a vacuum is applied from the underside of the surface. Although such vacuum hot plates are much simpler in construction than rotary preheating rolls, other processing problems have arisen.

Because a vacuum hot plate must be wide enough to process the widest conventional webs (e.g. 96" or about 2400 mm), when narrower paper webs are being processed, the lateral edges of the hot plate are exposed resulting in heat loss and the requirement for increased vacuum flow. In addition, the vacuum induced air flow around the edges of the web tends to provide a cooling effect resulting in uneven heating of the web.

BRIEF SUMMARY OF THE INVENTION

In accordance with the present invention, flexible edge seals are provided for a vacuum hot plate which reduce the vacuum flow requirements and minimize heat loss at the edges of the web, while minimizing drag on the web. The edge seal of the present invention comprises a pair of flexible edge sealing members, each of which is positioned to extend along and to overlie a lateral edge of the web moving over the heating surface of the hot plate and to rest upon a portion of the upper face of the web and on the heating surface laterally adjacent the edges of the web. The sealing members are provided with a pattern of through-holes which are positioned to preclude alignment of the holes in the portions of the membranes which rest upon the heating surface with the vacuum openings in the surface.

The vacuum openings in the heating surface of the hot plate are positioned in laterally extending, longitudinally spaced parallel rows, and the holes in the membrane are formed in laterally extending rows which are positioned between the rows of vacuum openings. The vacuum openings preferably comprise laterally elongate slots and the membrane holes comprise circular openings which are equally spaced laterally and longitudinally over the heating surface.

The membranes are preferably attached by their respective outer lateral edges to the outer lateral edge of the hot plate. The free lateral inner edges of the membranes may be lifted away from the heating surface and from the web, as for thread-up, maintenance and the like.

Various other features, objects, and advantages of the invention will be made apparent from the following detailed description and the drawings.

DETAILED DESCRIPTION OF THE PREFERRED EMBODIMENT

Figure 1:
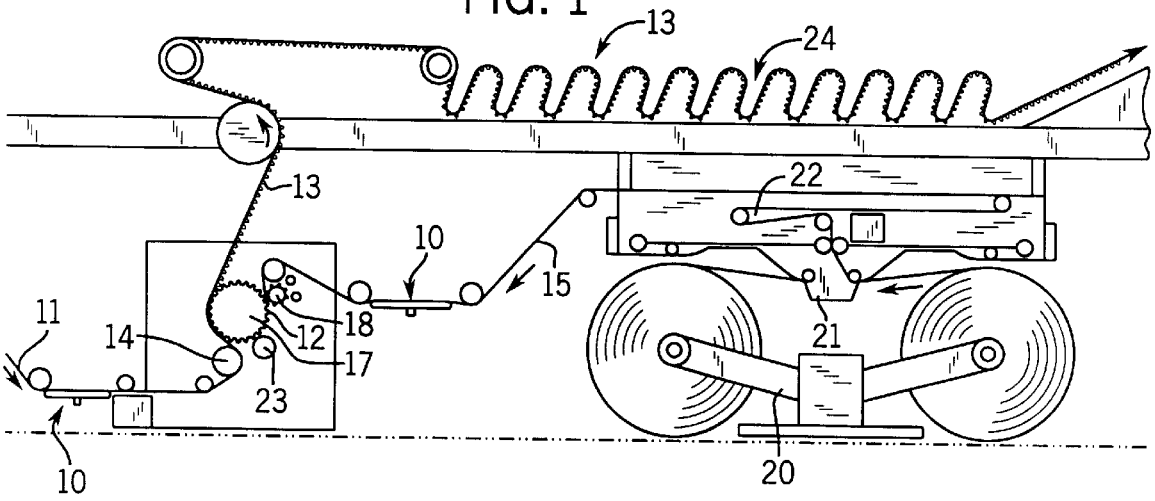
FIG. 1 is a schematic side elevation view of a corrugator single facer showing the use of vacuum preheaters of the subject invention for each of the paper webs.

In FIG. 1, a single facer, including two vacuum preheaters 10 of the present invention, operates to adhesively join a liner web 11 to a corrugated medium web 12 to form a composite single face web 13. The liner web 11 is typically delivered from a supply roll (not shown), through a splicer and into a web take-up mechanism, from which the web passes over the heated surface of a preheater 10 where the web is heated to enhance the bond by which it is subsequently joined to a medium web. From the preheater 10, the liner web 11 passes around a liner applicator roll 14 (which may also be heated) where it is joined with the corrugated medium web 12. The corrugated medium web is formed from a plain web 15 which is drawn from a roll stand supply 20 from which it travels through a splicer 21 and take-up mechanism 22 onto another vacuum preheater 10 of the present invention. From the preheater 10, the web 15 passes between corrugating rolls 17 and 18 which provide the web with the characteristic corrugated or fluted configuration to form the corrugated medium web 13. One or both of the corrugating rolls 17 and 18 may also be heated. A glue applicator 23 is positioned to apply an adhesive, such as an aqueous solution of a starch adhesive, to the tips of the corrugations on one side of the corrugated medium web 12 as it passes around the larger corrugating roll 17. The glued corrugated medium web 12 and the liner web 11 are joined at the interface between the liner roll 14 and the large heated corrugating roll 17. The continuing wrap of the single face web 13 around the large diameter heated corrugating roll 17 cures the adhesive bond. The single face web is then transferred into a varying length storage device 24 for further processing.

Figure 2:
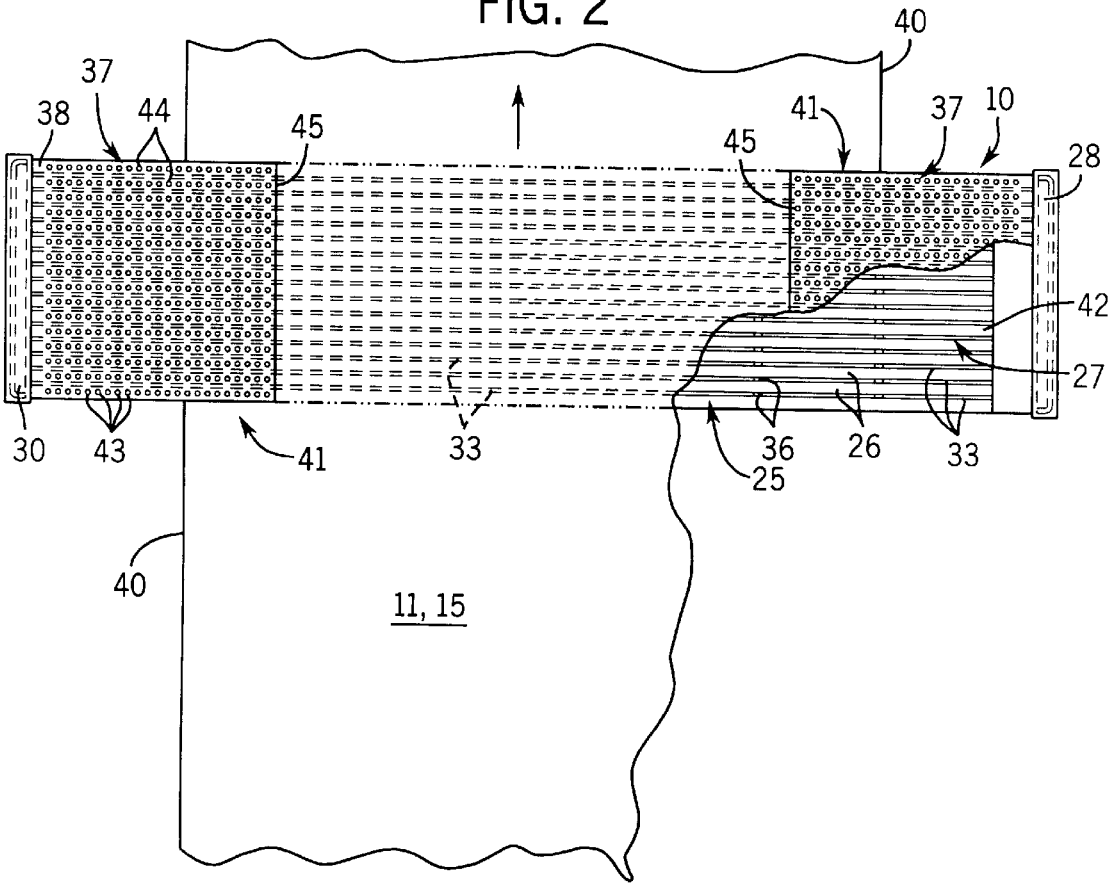
FIG. 2 is a top plan view of a preheater of the subject invention with portions of the sealing membrane and the web broken away to show details of the underlying apparatus.
Figure 3:
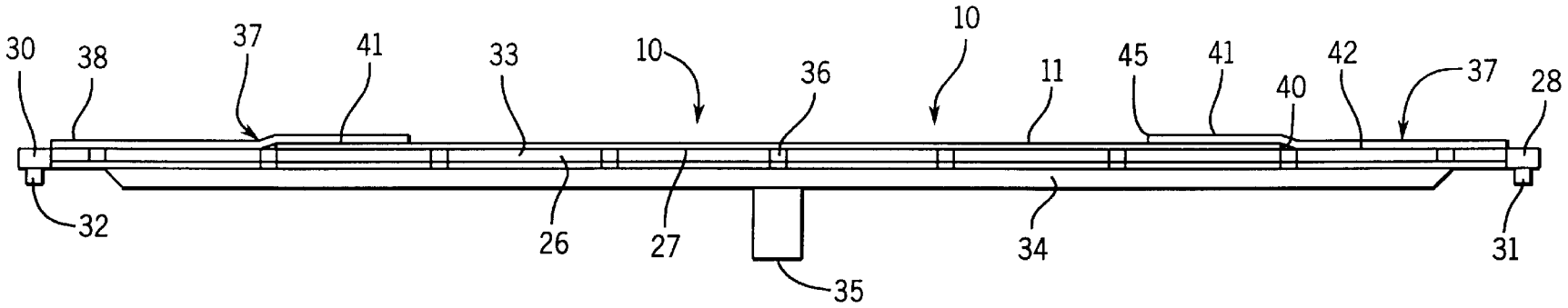
FIG. 3 is an end view of preheater shown in FIG. 2.
Figure 4:
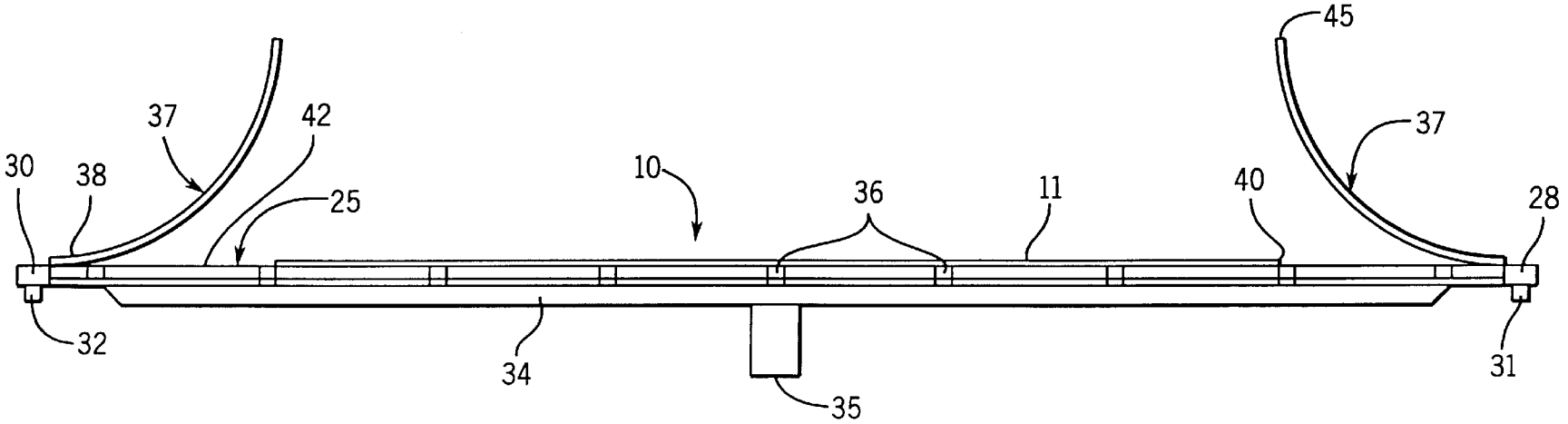
FIG. 4 is an end view similar to FIG. 3 showing the sealing membranes raised from their operative positions.

Referring now to FIGS. 2–4, preheating of both the liner web 11 and the corrugating web 15 is important in attaining a good bond in the single face web 13. Also, uniform heating of the webs translates into uniform strength in the glue lines. The vacuum preheaters 10, including the unique edge sealing membranes of the present invention, provide this uniform preheating.

Each preheater 10 includes a vacuum hot plate 25 made from a series of parallel square-section tubes 26 which together form a flat heating surface 27. The tubes 26 are open-ended and connected together at their respective opposite ends to a steam supply manifold 28 and a condensate collection manifold 30. Steam is supplied to the steam manifold 28 through a central steam connection 31 and condensate is removed from the condensate manifold 30 via a similar condensate connection 32.

The steam tubes 26 forming the heating surface 27 of the hot plate are mounted in slightly spaced relation such that the vertical side walls of adjacent tubes define vacuum slots 33 through the hot plate. A vacuum plenum 34 is attached to the underside of the hot plate to simultaneously apply a negative pressure through all of the vacuum slots 33 to the heating surface 27 of the plate. Vacuum is applied through a central vacuum connection 35. Preferably, the vacuum slots 33 are interrupted along their lengths (laterally across the hot plate) by a series of equally spaced separators 36.

A paper web 11 or 15 is fed over the heating surface 27 of the hot plate 25 where the application of vacuum holds the web in intimate contact with the heating surface and enhances heat transfer to the web. A pair of flexible sealing membranes 37 are attached, each by its laterally outer edge to the hot plate adjacent one of the manifolds 28 and 30. The sealing membranes 37 are the same width as the length of the hot plate in the direction of web movement, which may be about 24" or about 600 mm. The membranes may have a length (in the cross-web direction) of any suitable length depending upon the width of the web being processed and the total lateral width of the hot plate 25, the hot plate typically being about 98 inches (about 2500 mm) wide. If the hot plate is constructed to handle standard width paper web material, the maximum width of which is typically 96 inches (about 2400 mm), the length of the sealing membranes 37 in the lateral direction may be about 24" (about 600 mm). The sealing membranes 37 overlie the lateral edges 40 of the web 11 or 15, and rest upon edge portions 41 of the webs and on the heating surface portions 42 laterally adjacent and outside the width of the web.

Each sealing membrane 37 is provided with a pattern of through-holes 43 arranged in laterally extending parallel rows 44. The membranes are positioned on the hot plate 25 such that each row 44 of holes is generally centered along and overlies the flat surface of a tube 26. Correspondingly, none of the through-holes 44 is intended to overlie a vacuum slot 33. In this manner, the portions of the sealing membranes 37 which overlie the heating surface portions 42, not covered by the web 11, seal the heating surface against loss of vacuum through portions of vacuum slots 33 which would otherwise be uncovered. In addition, the holes in the sealing membranes which overlie the lateral edge portions 41 of the running web 11 allow air to be drawn through the holes and the underlying web portions, thereby minimizing the normal force of the membranes on the web and reducing friction and drag therebetween. Most significantly, however, the sealing of the lateral edges 40 of the web 11 against the unrestricted flow of vacuum-induced air precludes undesirable preferential cooling of the web edges, thereby enhancing more uniform heating of the web.

The membranes 37 are preferably made of a tough synthetic material having a low coefficient of thermal expansion, such as KEVLAR. This membrane material may also be combined with a low friction material, such as TEFLON.

The flexible membranes 37 may be lifted vertically by their free inner edges off the web and the heating surface to facilitate web thread-up, maintenance or the like.

It is recognized that other equivalents, alternatives, and modifications aside from those expressly stated, are possible and within the scope of the appended claims.

I claim:

1. An edge seal for a vacuum hot plate of the type having a heating surface supporting a moving web, the surface having a width exceeding the width of the web and vacuum opening in the surface through which air is drawn via a vacuum applied to the underside of the surface, said edge seal comprising:

a pair of flexible edge sealing membranes, each positioned to extend along and to overlie a lateral edge of the web on the heating surface and to rest upon a portion of the upper face of the web and on the heating surface laterally adjacent to the web; and, said membranes having a pattern of through-holes positioned to preclude alignment of the holes in the portion of the membranes resting on the heating surface with vacuum openings.

2. The apparatus as set forth in claim 1 wherein the vacuum openings in the heating surface are positioned in laterally extending longitudinally spaced parallel rows, and said membrane holes comprise laterally extending rows positioned between said rows of vacuum openings.

3. The apparatus as set forth in claim 2 wherein said vacuum openings comprise laterally elongate slots, and said membrane holes comprise circular openings equally spaced laterally and longitudinally of the heating surface.

4. The apparatus as set forth in claim 1 wherein said membranes are attached by an outer lateral edge to the outer lateral edge of the hot plate.

5. The apparatus as set forth in claim 4 wherein lateral inner edges of the membranes are liftable away from the heating surface and the web.

6. A method for improving the heating efficiency of a vacuum hot plate of the type having a heating surface supporting a moving web, the surface having a width exceeding the width of the web and vacuum openings in the surface through which air is drawn by a vacuum applied to the underside of the surface, said method comprising the steps of:

(1) positioning a pair of flexible edge sealing membranes on the lateral edges of the hot plate to extend along and to overlie a lateral edge of the web on the heating surface and to rest upon a portion of the upper face of the web and on the heating surface laterally adjacent to the web; and (2) providing the membranes with a pattern of through-holes positioned to preclude alignment of the holes in the portions of the membranes resting on the heating surface with the vacuum openings.

* * * * *